United States Patent [19]

Grillo

[11] 4,186,224

[45] Jan. 29, 1980

[54] RECORD MEMBER AND ENCAPSULATED CLAY FOR USE THEREIN

[75] Inventor: Thomas A. Grillo, Macon, Ga.

[73] Assignee: J. M. Huber Corporation, Locust, N.J.

[21] Appl. No.: 809,955

[22] Filed: Jun. 27, 1977

Related U.S. Application Data

[63] Continuation of Ser. No. 682,552, May 3, 1976, abandoned, which is a continuation of Ser. No. 532,658, Dec. 13, 1974, abandoned, which is a continuation of Ser. No. 386,635, Aug. 8, 1973, abandoned, which is a continuation of Ser. No. 155,018, Jun. 21, 1971, abandoned.

[51] Int. Cl.[2] ..... B41M 5/22

[52] U.S. Cl. ..... 427/221; 428/452; 428/327; 427/150; 428/407; 428/404; 282/27.5

[58] Field of Search ..... 427/221, 151, 150; 282/27.5; 428/325, 327, 404, 452, 407

[56] References Cited

U.S. PATENT DOCUMENTS

| | | | |
|---|---|---|---|
| 3,004,312 | 10/1961 | Froberger | 427/133 |
| 3,634,121 | 1/1972 | Brockett | 428/327 |
| 3,850,875 | 11/1974 | Robson | 260/42.14 |
| 3,856,551 | 12/1974 | Jenkins | 427/150 |

*Primary Examiner*—Sam Silverberg

*Attorney, Agent, or Firm*—Ernest A. Schaal; Harold H. Flanders

[57] ABSTRACT

An improved record member is disclosed of the type having a sensitized surface including an oil soluble acid-reactant organic polymer and a colorless acid type mineral such as kaolin clay. Sensitized surfaces of the foregoing type develop distinctive colors when contacted with a normally colorless oil solution containing two chromogenic materials which react, respectively in different time sequence, with the polymer and acid mineral. In the improved member kaolin particles are encapsulated within the said polymer material, whereby said sensitized surface possesses better and more uniform marking qualities. A method for preparation of the coating composition utilized in the member is also set forth.

3 Claims, 3 Drawing Figures

RECORD MEMBER AND ENCAPSULATED CLAY FOR USE THEREIN

This is a continuation of application Ser. No. 682,552, filed May 3, 1976 (now abandoned) by Thomas A. Grillo on IMPROVED RECORD MEMBER AND ENCAPSULATED CLAY FOR USE THEREIN; which was a continuation of Ser. No. 532,658, filed Dec. 13, 1974 by Thomas A. Grillo on IMPROVED RECORD MEMBER AND ENCAPSULATED CLAY FOR USE THEREON (now abandoned); which was a continuation of Ser. No. 386,635, filed Aug. 8, 1973 by Thomas A. Grillo on IMPROVED RECORD MEMBER AND ENCAPSULATED CLAY FOR USE THEREON (now abandoned); which was a continuation of Ser. No. 155,018, filed June 21, 1971 by Thomas A. Grillo on RECORD MEMBER AND ENCAPSULATED CLAY FOR USE THEREIN (now abandoned).

BACKGROUND OF THE INVENTION

This invention relates generally to record materials, and more specifically relates to record materials of the type having a sensitized surface which reacts to a colorless ink applied thereto by displaying distinctive colors in the image-configurated areas where said ink is present.

Within recent years a highly successful recording system has come into use based upon a multiple coloring principle in which an oily ink having two types of chromogenic reactants, normally colorless, is used upon an ink-receiving sheet sensitized with materials which react respectively with the two chromogenic substances to yield distinctive coloration. In one version of such system the said ink-receiving sheet is sensitized with substantially insoluble acid-like materials of high surface activity, such as attapulgite and zeolite, the chromogenic reactants being such substances as Crystal Violet Lactone and Benzoyl Leuco Methylene Blue. Such a system is disclosed, for example, in U.S. Pat. No. 2,712,507 to Barret K. Green, pertaining to the well-known "NCR" paper (the quoted phrase being a trademark of the National Cash Register Company), wherein the said ink is applied from an oversheet by pressure-release from microscopic capsules. In recording systems of this type the coloration of Crystal Violet Lactone is effected by an electron donor-acceptor solid-surface reaction with the acid clay-like mineral and the coloration of the Benzoyl Leuco Methylene Blue is brought about by hydrolysis followed by an oxidation-reduction reaction.

Because of the considerable time differential present with respect to completion of the two coloration reactions for the Crystal Violet Lactone and the Benzoyl Leuco Methylene Blue, an hiatus is often found to exist in the continuity of existence of the recorded marks produced by the previously described system. As such problem has been demonstrated to largely result from the fact that the two coloration reactions occur entirely via solid-surface reaction, improved record members have been developed wherein the coloration reactions are not dependent upon absorption on a solid surface-active material. Such an improved system is set forth, for example, in U.S. Pat. No. 3,455,721, wherein a record member is disclosed carrying in recording areas two types of microfine particles: the first an oil soluble acid-reactant organic polymeric material; the second, a colorless acid-type of mineral such as kaolin clay. When the previously described oily ink is applied to such a member, the polymeric particles enter the oil solution and promptly bring about the electron donor-acceptor reaction which effects coloration in Crystal Violet Lactone. At the same time contact of the oily ink with the acid type mineral initiates the oxidation reduction reaction which in time colorates the Benzoyl Leuco Methylene Blue dye. Because coloration of the Crystal Violet Lactone occurs in solution, the colored material is capable of entering the support sheet, and this coupled with the absence of particle contamination such as occurs where surface active particles are used, assures much greater persistence in coloration of the said dye.

Additional disclosures relative to the state of the art in which the present invention occurred may be found in U.S. Pat. Nos. 2,173,346; 2,463,501; 2,674,587; 3,516,845; 3,525,630; 3,535,412; British Pat. Nos. 1,212,731; 1,215,618; and Canadian Pat. Nos. 852,785 and 864,009.

The concept of using both an oil soluble polymer material and an acid-type mineral in the manner as set forth above, is less than satisfactory in the important respect that utilization of discrete particles of the one end of the other materials necessarily introduces undesirable discontinuitives into the recording surface, with a consequent loss of resolution and uniformity in the marking qualities of such surface. In particular it will be evident that even with the most uniform distribution of discrete particles, one particle type being uniformly dispensed among the other, coloration will occur—whether in the case of Crystal Violet Lactone or of Benzoyl Leuco Methylene Blue—at points spaced by the intervening alternate type particles. Such a result is compounded by the fact that ideal uniform distribution of one group of particle types among the other is, of course, not achieved in practice.

SUMMARY OF THE INVENTION

In accordance with the foregoing, it may be regarded as an object of the present invention to provide a record member for receiving an oily colorless ink containing chromogenic materials that react to colorate respectively with an oil soluble acid-reactant organic polymer material and with a colorless acid-type of mineral, wherein said polymeric and mineral materials are present at the surface of said record member in a form yielding exceptional resolution and uniformity of recording.

It is further an object of the invention to provide a clay-polymeric material composition which enables the result set forth in the preceeding paragraph, and to provide a process and apparatus for production of the said composition.

Now in accordance with the present invention, the foregoing objects, and others as will become apparent in the cause of the ensuing specification, are achieved by coating the base sheet of paper or other fibroin material with a composition wherein the acid-type mineral, such as kaolin clay, is present as a microfine dispersion of particles, individual of said particles being encapsulated within the said polymeric material, thereby producing a recording member the sensitized surface of which presents to the oily ink applied thereto an essentially unbroken polymeric layer in which individual mineral particles are effectively embedded. The said coating composition is, in accordance with the invention, produced by a process wherein the heated mineral—preferably kaolin clay—is combined with a heated liquid polymer preferably dispersed in a solvent, and the combined mix subjected to high shear mixing and compaction. Thereafter the admixtures may be desolventized—preferably in the presence of continuing shearing forces—and milled. The resulting composition may then be coated upon base sheet by standard methods to yield the desired recording member.

DESCRIPTION OF THE PREFERRED EMBODIMENTS

Figure 1:
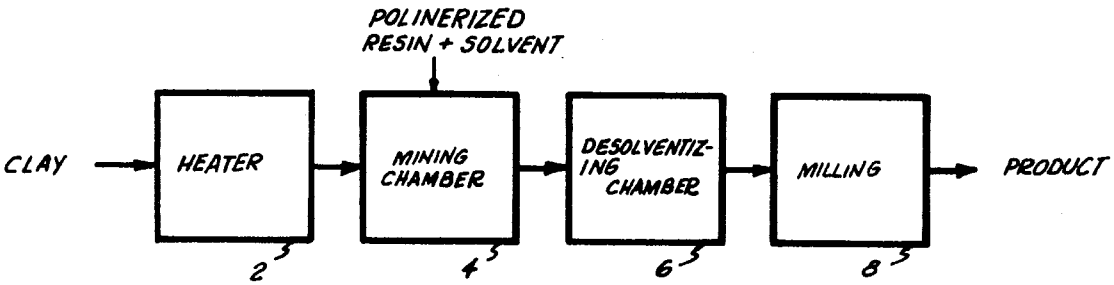
FIG. 1 is a schematic flow diagram setting forth the sequential process steps enabling formation of the coating composition of the present invention.

In accordance with one preferred process for preparing the composition of the invention, the acid-type mineral intended for use in the composition is initially fed to a conventional heater station such as is schematically designated at reference numeral 2 in FIG. 1.

While it is possible to carry out the present invention without the use of heater station 2 as will be described hereinafter, it has been found particularly advantageous to utilize such heater as will be demonstrated later.

The preferred material for such acid-type mineral is a white kaolin clay such as, for example, the clay of this type available from the J. M. Huber Corporation of Huber, Georgia under the designation special "Hydratex".

Such clays as are preferred as starting materials in the present invention are generally paper coating grade clays derived from water fractionated Georgia kaolins having a TAPPI Brightness (in percentage reflectance) of at least 85 and approximately 80% of their particle size distribution finer than two (2) microns with less than 6% of their particles coarser than five (5) microns. Such clays generally have a Brookfield viscosity measured in a 70% clay slip with a #1 spindle at 20 revolutions per minute at 25° C. of 100–200 cps. Typical properties of such clays are an average equivalent spherical particle diameter of 0.8 microns, a specific gravity of 2.60, an oil absorption of approximately 30 gms/100 gms. a pH of on the order of 4.5–5.0 measured with 100 gms of clay/250 ml. water, a refractive index on the order of 1.5–1.6 and a BET surface area on the order of 10–11 $m^2/g$.

Clays of this type are ideal for the present application in that in addition to possessing the necessary acid properties, their plate-like particle form, whiteness, and their ready availability lend them unparalleled paper coating advantages. Other types of particulate, colorless, water and oil-insoluble acid-type clays and other minerals such as some of the bentonites, can also be used in the invention, although these latter materials do not possess as favorable rheological characteristics as do the kaolin clays.

When the kaolin clays are thus utilized, they will representatively be heated below 140° C., preferably to the temperature range of 100° to 120° C. Thereafter, as is shown in FIG. 1, the heated clay is passed to a mixing chamber 4 where it is combined in the presence of high intensity shearing with a suitable polymerized resin and a diluting solvent for the resin.

The solvent may be added with the resin or may be added to the mixing chamber following addition of the resin or may in some cases as discussed hereinafter be omitted.

The polymerized resin materials utilized with the present invention may be any of the substances of this type set forth in U.S. Pat. No. 3,455,721, previously alluded to. Thus among the oil-soluble organic polymeric materials suitable for use in this invention together with appropriate ink solvents to be used therewith, certain phenol-aldehyde and phenol-acetylene polymers, maleic acid-rosin resins, partially or wholly hydrolyzed styrene-maleic anhydride copolymers, ethylene-maleic anhydride copolymers, carboxy polymethylene, and wholly or partially hydrolyzed vinyl methyl ether-maleic anhydride copolymers are specified as typical of the reactive acidic polymeric materials.

Of the phenol-aldehyde resin group, examples of typically suitable resins include:

"Bakelite" phenolic coating materials manufactured by Union Carbide, meeting Federal Specification No. TT-R-271 and Military Specification No. MIL-R-15184A, which are non-heat-reactive, 100% paraphenylphenol, oil soluble resins having a softening point range of 195°–225° F. and a specific gravity at 25° C. of 1.20–1.23.

A p-phenylphenol resin prepared from a monomer having a general structural formula,

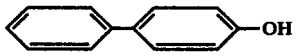

a molecular weight of 170.2, a freezing point of 166.5° C., a boiling point at 760 mm. Hg of 321° C., and a specific gravity at 25° C. of 1.275.

A p-sec-butylphenol resin prepared from a monomer having a general structural formula,

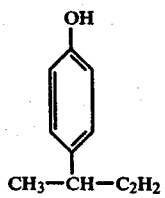

a molecular weight of 150.2, a boiling range at 25 mm. Hg of 135.4–136.5, and a specific gravity at 60° C. of 0.963.

A p-tert-butylphenol resin prepared from a monomer having a general structural formula,

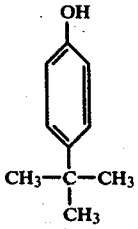

a molecular weight of 150.2, a boiling range at 760 mm. Hg of 237–239.7° C. and a specific gravity at 25° C. of 1.037.

Bisphenol A resins prepared from a monomer having a general structural formula,

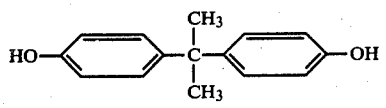

a molecular weight of 228.3, a boiling point at 4 mm. Hg of 220° C. and a specific gravity at 25° C. of 1.195, and other known resins of the type described herein.

Of preferable use in the invention are the para-phenylphenol-aldehyde polymerization products. At least a dimer structure having $CH_2OH$ end bonds for a terminable structure is desirable.

It is believed that a desirable molecular weight distribution may include 5% monomer, 15–20% dimer, approximately 20% trimer and the remaining portions of high molecular weights.

The admixture of polymerized resin and diluting solvent—which may for example comprise xylene or the like—may itself be heated on the order of 90° to 125° C. prior to addition to mixing chamber 4. Temperatures in mixing chamber 4 are maintained in the range of 100° to 130° C. and the mix of polymeric material, solvent, and kaolin clay is therein subjected to a high intensity, high shear mixing and compaction action, following which the mix is transferred to a desolventizing chamber 6. The latter may simply comprise a heat room wherein temperatures are maintained of the order of 120° F. to fully evaporate the solvent. During such desolventization the mix is preferably subjected to a shearing action as by mixer blades or the like. Subsequently the mix is transferred to a milling station 8 which may preferably include bead grinding of the material, after which the product emerges in a form suitable for coating upon paper webs or other fibrous base sheets by standard techniques known in the paper coating art.

The desired high intensity, high shear mixing action described in connection with the mixing chamber 4 is preferably brought about by the apparatus shown in the partially sectioned, partially broken-away view of FIG. 2. A pin mixer 10 is shown therein generally comprising a cylindrical container 12 provided with upper and lower end plates 14 and 16, a feed inlet 18 at the upper end thereof, and a feed outlet 20 at the lower end thereof. A power shaft 22 is journaled by bearing blocks 24 and 26 and passes into container 12 where it widens to form a mixer shaft 28. Container 12 together with the other components of the apparatus set forth are mounted upon a support stand 30, which is seen to so support container 12 that a natural gravity flow is provided through the apparatus from inlet 18 to outlet 20. Because of the flow direction specified—and the compaction action which will be set forth below—it is necessary to seal the shaft 28–22 at its lower end, and it will be seen that a packing gland 32 is provided for such purposes.

Mixer shaft 28 is seen to be provided with a helically formed array of rounded pins 34. Such pins 34 serve as the primary means achieving mixing and breaking up of agglomerates in apparatus 10. Typically, apparatus 10 will be operated at rotational speeds of the order of 100 to 1,000 RPM, and will act both as a mixer and as a mill to break up the agglomerates. It will be observed that the pitch of the helix formed by pins 34—which is suggested by the dotted line 36 in the Figure—decreases from the upper end of mixer shaft 28 toward the lower end thereof. In consequence of this decreasing pitch arrangement and of the gravitationally directed flow toward the shaft end with decreasing pitch, compaction and increased inner-particulate shear ensue as the mix passes through apparatus 10. Both of these phenomena are believed to be significant in accomplishing clay encapsulation in accordance with the invention. In particular when mixes are thus processed in accordance with the scheme set forth it is found that they do indeed result in coating compositions wherein the kaolin clay is thoroughly encapsulated in the polymeric materials as previously described, and when such mixes are thereafter utilized in preparing coated recording members for use in record systems of the "NCR" type previously referred to, that a new and superior member is enabled having resolution and marking qualities of a greatly improved nature. In essence such result stems from the fact that when the composition of the invention is coated upon its support base, an essentially continuous surface of polymeric material is presented to the reactive oily ink subsequently applied hereto, with the individual kaolin clay particles being entirely encapsulated and embedded in the polymeric material, and thus below the immediately accessible record surface.

Evidence of the fact that the above described process actually results in the clay being encapsulated in the resin is found in the discovery that when produced in accord with the present invention the resin is not separable from the clay by mechanical means, froth flotation or the like as were the resin-clays of the prior art.

As will be demonstrated hereinafter a resin coating of less than 10%, preferably on the order of 7.5%, has been found operative while prior art systems generally required in excess of 15% resin in operative coatings.

This reduction in resin content is significant in the economics of the system and provides clear evidence of the synergism of the present invention as compared with prior art physical blends.

Figure 3:
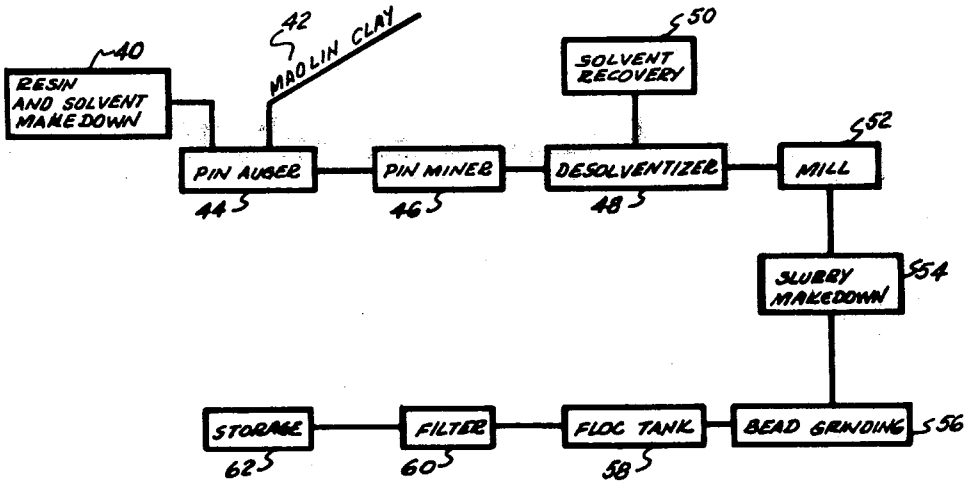
FIG. 3 is a schematic flow diagram setting forth the sequential process steps of a particularly preferred process embodiment enabling formation of the coating composition of the present invention.
Figure 3:
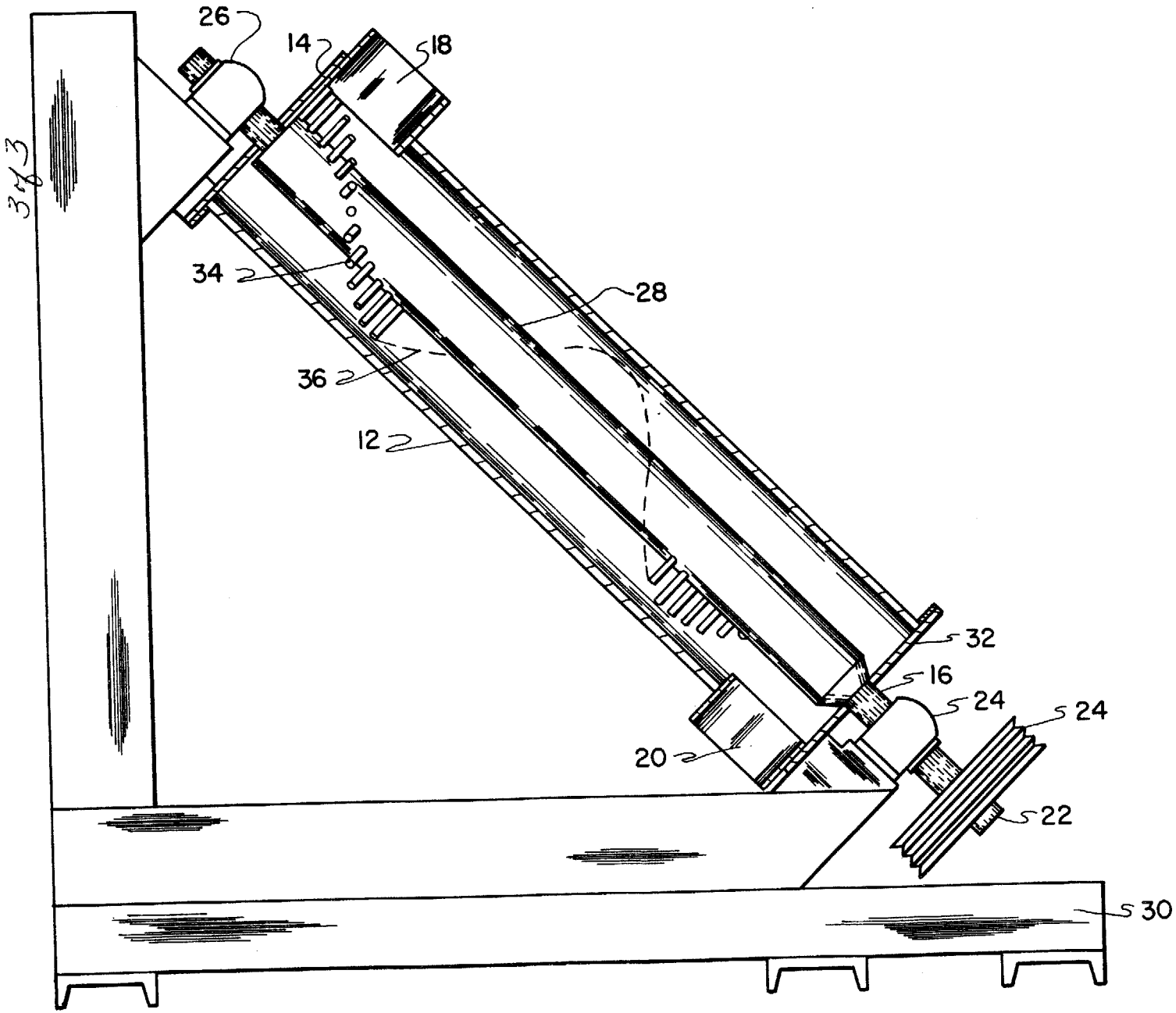

A particularly advantageous and preferred method embodiment of the present invention is shown in FIG. 3.

A polymerization reaction producing, for example, a para-phenyl phenol/formaldehyde resin is carried out, as will be hereinafter described, in the absence of clay.

The resin polymerization product is made down at 40 with a solvent such as xylene. The solvent helps to extend the resin and allows for more uniform coverage of the clay in subsequent steps. A preheated kaolin clay 42 is added along with the resin solvent makedown to a steam heated pin auger 44 where the hot clay particles are coated with resin in a liquid form. The heated clay helps keep the resin fluid throughout the treating operation and in later steps aids in desolventizing the modified clay. The process may be carried out utilizing unheated clay if the solvent level is increased accordingly. Sufficiently heated clay may be employed as to reduce or eliminate the need for additional heating in the mixing steps.

Typically, auger 44 may be fed at the rate of 3 tons of clay per hour with the resin-solvent flow regulated to coat the clay with approximately 7.5% resin based on the clay.

The modified clay discharged from auger 44 may be somewhat agglomerated and is thus passed into and through a pin mixer 46 to reduce the average agglomerate size and to make the modification more uniform.

The output of pin mixer 46 is then passed to desolventizer 48 which is a jacketed, steam heated, double screw auger conveyor designed to remove volatiles. The solvent is vented to solvent recovery apparatus 50.

The desolventized, modified clay may then preferably be cooled to prevent degradation of the resin encapsulation.

Subsequently the modified clay is passed to impact mill 52 to reduce the particle and agglomerate size of the modified clay.

The milled product is then made down in water in slurry makedown tanks 54.

Following slurry makedown at 54 the slurry is passed to a bead grinding mill 56 which breaks down any resin-cemented clay particles and brings the particle size of the modified clay back in line with the starting clay.

The bead grinding mill 56 applys small, numerous, equally distributed impacts to the clay particles suspended in the aqueous slurry. The number, frequency, and magnitude of these impacts can also be controlled to a high degree.

This is accomplished by suspending a large number of hard microspheroidal particles in the clay slurry and applying a slow, steady stirring to the slurry. Any type of agitating means may be applied as long as it results in a movement of the slurry. The agitation results in minute impacts and shearing forces arising between the microspheroids and the clay booklets. The agitation rate can be controlled as can the size and concentration of microspheroids in order to limit the impact and shearing forces applied to the clay particles.

The practical limits of the impact work on each particle, although they cannot be measured directly, can be measured empirically by measuring the rheological and coating properties of various clay slurries which were worked under varying conditions.

Thus, it is not necessary to know the maximum work a platelet can withstand without transverse shearing, nor the minimum amount of work which will separate the platelets of a booklet particle.

Instead, the rate and total amount of agitation, amount of microspheroidal media, and size of the microspheroids which produce the most desirable clay product for coating or for pigment uses can be determined experimentally in a slurry-by-slurry batch experiment.

The grinding media found to be particularly suitable was microspheroids of an aluminum magnesium alloy. This alloy gives a microspheroid of favorable density (specific gravity between 2 and 3) sufficient hardness, and non-abrasiveness to the vessels and machinery. A second media also found to be particularly adapted for this type of work was glass microspheroids. The cost of the aluminum-magnesium alloy makes it less desirable than glass on a mass volume basis.

The most favorable and economical grinding media consists of microspheroids of a glass having a specific gravity of around 2.45. These microspheroids exhibitied a high crush strength and low abrasion effect on the vessels and machinery.

These glass microspheroids have been found to provide a faster grinding rate than materials such as sand and plastic due to their hardness and spherical nature which provides better contact. As compared to sand, they have a lower specific gravity, are easier to suspend, and, thus, require less power in mixing. Glass microspheroids have a higher crush strength and therefore provide less contamination than sand. They are more homogeneous in structure and, in general, have less fractures or fissures to weaken them and cause breakage. Also, a variety of glass microspheroids are commercially available with a more uniform spherical shape which results in a faster grinding and better contact of the media. In addition to the before-mentioned variables, such as the media/slurry ratio, agitation speed, etc., various effects may be obtained by balancing size versus the number or frequency of impingements. Thus, glass microspheroids permit somewhat tailored results by allowing various sized distributions of the microspheroids to be used. One can achieve optimum effects by proper selection of their size. An increase in the size of media yields larger grinding intensity and forces but fewer impingements. Further, the microspheroids provide for better intermittent operation because they are easier to re-suspend on start-up. In summary, they provide high strength and wear resistance, and are inert and non-contaminating. As set forth above, the specific gravity of the media should be greater than that of the clay-water suspension. A clay-water slurry containing 30% clay has a specific gravity of approximately 1.23, whereas the preferred media generally has a specific gravity of about 2.45.

A media suitable for use in the present invention is that identified as Class IV, Type 203 Uni-Spheres, manufactured by the Microbeads Division of Cataphote Corporation, which consists of microspheroids having a specific gravity of about 2.45 and a diameter in the range of about 20 mesh to 30 mesh (Tyler standard screen scale). It has been discovered that the use of glass media, as heretofore described, permits substantially complete reduction to the required fineness in one pass, in contrast to known processes wherein a portion of the ground material must be recycled to the grinding apparatus or discarded. While other media, such as Ottawa sand and small fused alumina spheres, may be employed, such media having a greater specific gravity are more difficult to suspend, require more power in mixing and do not otherwise offer the unique advantages of the glass microspheroids.

The process of selective bead grinding can be carried out as a batch operation or as a continuous process. Preferably, it is carried out in a continuous manner with the suspension of clay in water circulating through an agitated suspension of grinding media with the clay suspension flowing from the grinding tank through a screen which restrains the media. In either batchwise or continuous operation, agitation of the hard, abrasive media in the clay suspension is sufficient to provide the percussive and frictional milling action required to produce particle size reduction. In general, any conventional tank or vessel equipped with agitating means, etc., may be employed. Suitable apparatus are disclosed in U.S. Pat. Nos. 3,075,710 and 3,171,718. Preferably, the vessel and agitator are covered with rubber or other suitable elastomer to avoid corrosion and wear of the metal parts.

It has been found that the rate of grinding increases as the volume of the grinding media to the volume of slurry increases. For example, for a 30% solids modified clay slurry with a mixing time of 30 minutes and an impeller speed of 1300 f.p.m. as the media:slurry ratio was varied from 40:60 to 60:40 the percentage of particles produced smaller than 2 microns increased from 60% to 90%.

It has also been found that the grinding rate increases with increasing impeller speed up to approximately 1000 f.p.m. and then levels off. Of course the effectiveness of impeller speed varies with such factors as type of impeller and the dimensions of the impeller and tank.

It has also been found that faster grinding is obtained when the slurry contains less than about 40% by weight of clay.

The effect of residence time on modified pigments of the present invention is illustrated in the following example:

EXAMPLE 1

Five hundred pounds of a milled 10% modification clay was slurried to a 30% solids slurry with 6 pounds per ton of TSPP as a dispersing agent present. This slurry was subjected to bead grinding with glass beads as indicated above with a 45:55 grinding media to slurry ratio at an impeller speed of 1250 r.p.m. producing a peripheral speed of 1960 feet per minute for varying retention times as shown below. A three pound coating of 50 pound Mead stock was used for evaluation. The results are shown in Table I below.

TABLE I

RESIDENCE TIME STUDY FOR BEAD GRINDING

| Retention Time Minutes | 325 Mesh Residue | Brightness | Particle Size %-2 Micron | Dye Development |
|---|---|---|---|---|
| 0-Control | 3.5848% | 78.5 | 61.8 | Good |
| 10 | 0.0252 | 83.0 | 63.8 | Excellent |
| 20 | 0.0079 | 83.2 | 70.0 | Excellent |
| 30 | 0.0048 | 83.7 | 75.4 | Excellent |
| 45 | 0.0078 | 84.4 | 83.8 | Poor |
| 60 | 0.0056 | 83.5 | 84.9 | Poor |

The above indicates that excessive bead grinding has a deleterious effect on the coating properties of the modified clay, since excess grinding removes the encapsulating resin from the clay and produces a mere physical mixture of the resin and clay similar to the prior art compositions.

Following bead grinding at 56 the modified clay is passed to a flocculation tank 58 and then through filters 60 to raise the solids content. The filter cake may then be prepared for shipment or passed to storage tanks 62.

The following examples illustrate the modification of clays in accord with the present invention.

EXAMPLE 2

A one liter reaction kettle was charged with the chemicals listed below. The charge was then heated until refluxing started. The refluxing was carried on for one hour at 90° C., ±5°. Solvents ($H_2O$ and xylene) were then extracted for a period of one hour. The resin was then cooked for one hour. The resin was then added to 7.5 pounds of a water fractionated Georgia kaolin having a TAPPI brightness of 86% reflectance, 92–95% of its particles less than 2 microns, a Brookfield viscosity (70% clay slip, 20 r.p.m., #1 spindle, 25° C.) of 200–400 cps, a specific gravity (25° C.) of 2.6, a refractive index of 1.5–1.6, and a BET surface area of 22 $m^2/g$. This clay had been heated in a kneader which was heated with a circulating steam. The resin modified clay was then kneaded for 10 minutes and milled.

| Chemicals Used | Amount in Grams | % Chemical Used Based On Clay Used |
|---|---|---|
| Para Phenyl Phenol | 238.0 | 7.00 |
| 37% HCHO | 122.0 | 3.58 (1.32 dry formaldehyde) |
| Xylene | 112.0 | 3.3 |
| 75% Solution Aerosol OT | 0.53 | 0.015 |
| Oxalic Acid | 2.6 | 0.077 |

EXAMPLE 3

A one liter reaction kettle was charged with the chemicals listed below. The charge was heated for 20 minutes at which time refluxing began (88° C.). Refluxing was carried out for one hour and $H_2O$ extraction then started. Resin was then added to 7.5 pounds of the clay of Example 2 which had been heated in a kneader by circulating steam. The resin modified clay was kneaded for 7 minutes and then milled.

| Chemicals Used | Amount in Grams | % Chemical Used Based On Clay Used |
|---|---|---|
| Para Phenyl Phenol | 238.0 | 7.00 |
| 37.0% $CH_2O$ | 122.0 | 3.58 (1.32 dry formaldehyde) |
| Xylene | 112.0 | 3.3 |
| Aerosol OT (75% solution) | 0.53 | 0.015 |
| Oxalic Acid | 2.6 | 0.077 |

EXAMPLE 4

A one liter reaction kettle was charged with the chemicals listed below. The charge was then heated for 30 minutes until refluxing started (84° C.). Refluxing was carried out for 1 hour after which $H_2O$ extraction started. $H_2O$ extraction was carried out until 100.0 mls. were removed (Temperature before extraction 91° C.—after extraction 117° C.). The resin was then added to 7.5 pounds of the clay of Example 2 which had been heated by circulating steam through a kneader. The resin modified clay was kneaded for 7 minutes and then milled.

| Chemicals Used | Amount in Grams | % Chemical Used Based On Clay Used |
|---|---|---|
| Para Phenyl Phenol | 238.0 | 7.0 |
| 37.0% $CH_2O$ | 122.0 | 3.58 (1.32% dry formaldehyde) |
| Xylene | 224.0 | 6.6 |
| Aerosol OT (75% solution) | 0.53 | 0.015 |
| Oxalic Acid | 2.6 | 0.077 |

EXAMPLE 5

A one liter reaction kettle was charged with the chemicals listed below. The charge was then heated for 20 minutes until refluxing began (91° C.). Refluxing was carried out for 1 hour at which time $H_2O$ extraction started. $H_2O$ extraction was carried out until 86.7 mls. was removed (temperature before extraction 91° C.—after extraction 110° C.). A resin modified clay was then prepared (blended) the same as in Example 4 above.

| Chemicals Used | Amount in Grams | % Chemical Used Based On Clay Used |
|---|---|---|
| Para Phenyl Phenol | 206.3 | 6.06 |
| 37.0% $CH_2O$ | 105.7 | 3.10 |
| Xylene | 194.1 | 5.70 |
| Aerosol OT (75% solution) | 0.46 | 0.014 |
| Oxalic Acid | 2.25 | 0.066 |

EXAMPLE 6

A one liter reaction kettle was charged with the chemicals listed below. The charge was heated for 25 minutes (temperature—26° C., Power-stat setting—100) and heated at which time refluxing began (85° C.). Refluxing was carried out for one hour at which time $H_2O$ extraction started. The resin was then added to 7.5 pounds of a clay as set forth as preferred in the specification above which had been heated in a kneader by circulating steam. The resin modified clay was kneaded for 7 minutes and then milled.

| Chemicals Used | Amount in Grams | % Chemical Used Based On Clay Used |
|---|---|---|
| Para Phenyl Phenol | 318.0 | 9.33 |
| 37.0% $CH_2O$ | 163.0 | 4.8 |
| Xylene | 200.0 | 5.87 |
| Aerosol OT (75% solution) | 0.93 | 0.027 |
| Oxalic Acid | 4.7 | 0.14 |

EXAMPLE 7

A one liter kettle was charged with the chemicals listed below. The charge was heated for 20 minutes at which time refluxing began (88° C.). Refluxing was carried out for one hour at which time $H_2O$ extraction was started (91° C.). Extraction was carried out until 69.0 mls. were extracted (120° C.). Resin was then added to 7.5 pounds of the clay of Example 6 and treated as in Example 6 above.

| Chemicals Used | Amount in Grams | % Chemical Used Based On Clay Used |
|---|---|---|
| Para Phenyl Phenol | 159 | 4.52 |
| 37.0% $CH_2O$ | 81 | 2.38 |
| Xylene | 200 | 5.87 |
| Aerosol OT (75% solution) | 0.46 | 0.014 |
| Oxalic Acid | 2.35 | 0.069 |

EXAMPLE 8

A three liter flask was charged with the chemicals listed below. The charge was heated for 20 minutes at which time refluxing started (88° C.). Refluxing was carried out for one hour at which time $H_2O$ extraction was started (91° C.). $H_2O$ extraction was carried out until 400 mls. of $H_2O$ had been extracted. The resin was than added to 30 pounds of clay as in Example 7 and mixed for 10 minutes. The resin modified clay was dried in a heat room and then milled.

| Chemicals Used | Amount in Grams | % Chemical Used Based On Clay Used |
|---|---|---|
| Para Phenyl Phenol | 954 | 7.00 |
| 37.0% $CH_2O$ | 486 | 3.57 |
| Xylene | 300 | 2.20 |
| Aerosol OT (75% solution) | 2.1 | 0.015 |
| Oxalic Acid | 10.5 | 0.077 |

EXAMPLE 9

A three liter flask was charged with the chemicals listed below. The charge was heated until refluxing began (86° C.). Refluxing was carried out 30 minutes after which 50.0 mls. of Xylene were added to the charge and refluxing was carried out for an additional 30 minutes. The charge was then added to 2.8# of clay (which had been slurried to 50.0% solids) and heated to 90° C. Slurry/resin charge was then dried and milled.

| Chemicals Used | Amount in Grams | % Chemical Used Based On Clay Used |
|---|---|---|
| Para Phenyl Phenol | 119 | 9.36 |
| 37.0% $CH_2O$ | 61 | 4.8 |
| Xylene | 25 | 1.97 |
| Polycomplex Q (Solubilizer from Guardian Chemical Corporation) | 25 | 1.97 |
| Aerosol OT (75% solution) | 0.35 | 0.03 |
| Oxalic Acid | 1.3 | 0.12 |
| $H_2O$ | 100 | 7.87 |

EXAMPLE 10

A one liter reaction kettle was charged with the chemicals listed below. The charge was heated for 30 minutes at which time refluxing began (86° C.). Refluxing was carried out for one hour at which time $H_2O$ extraction started. $H_2O$ extraction was carried out until 100 mls. of $H_2O$ was extracted (temperature before extraction 91° C.—after extraction 130° C.). The resin was then added to 7.5 pounds of clay which had been heated in a kneader by circulating steam. The resin modified clay was kneaded for 12 minutes, dried and then milled.

| Chemicals Used | Amount in Grams | % Chemical Used Based On Clay Used |
|---|---|---|
| Para Phenyl Phenol | 238 | 7.0 |
| 37.0% $CH_2O$ | 122 | 3.58 |
| Xylene | 476 | 13.98 |
| Aerosol OT (75% solution) | 0.53 | 0.015 |
| Oxalic Acid | 2.6 | 0.077 |

EXAMPLE 11

A one liter reaction kettle was charged with 223 grams of para phenyl phenol, 170 grams of $CH_2O$ (37.0% solution), 0.93 grams Aerosol OT (75.0% solution) and 300 grams of Xylene. The charge was heated for 20 minutes at which time refluxing began (84° C.). Refluxing was carried out for 45 minutes at which time 94.5 grams of p-sec-butyl-phenol which had been dissolved in 100 grams of xylene was added to the reaction kettle. Refluxing was then carried out for 15 additional minutes. $H_2O$ extraction was then started (90° C.) and carried out until 100.0 ml. were extracted (temperature 107° C. after extraction). The resin was then added to 7.5 pounds of the clay of Example 2 which had been heated in a kneader by circulating steam. The resin modified clay was mixed for 10 minutes, dried and milled.

EXAMPLE 12

A one liter reaction kettle was charged with 167.0 grams of para phenyl phenol, 170 grams of $CH_2O$ (37.0% solution), 0.7 gram Aerosol OT (75.0% solution) and 200 grams xylene. The charge was heated until refluxing began (84° C.). Refluxing was carried out for 45 minutes at which time 70.9 grams of p-sec-butyl phenol which had been dissolved in 100 grams of xylene was added to the kettle. Refluxing was carried out for an additional 15 minutes. $H_2O$ extraction was then begun and carried out until 100.0 mls. $H_2O$ had been removed. The resin was added to 7.5 pounds of the clay of Example 2 which had been heated in a kneader by circulating steam. The resin modified clay was mixed for 10 minutes, dried, and milled.

EXAMPLE 13

A one liter reaction kettle was charged with 140.1 grams of para phenyl phenol, 141.8 grams of $CH_2O$ (37.0% solution), 0.93 grams Aerosol OT (75.0% solution), 4.7 grams oxalic acid and 200 grams of xylene. The charge was heated for 15 minutes at which time refluxing began (82° C.). Refluxing was carried out for 45 minutes at which time 138.8 grams of p-sec-butyl-phenol which had been dissolved in 200 grams xylene was added to the kettle. Refluxing was carried out for an additional 15 minutes at which time $H_2O$ extraction started. $H_2O$ extraction was carried out for 40 minutes to extract 116 mls. $H_2O$. The resin was then added to the clay of Example 2 and processed as in Example 12.

EXAMPLE 14

A one liter reaction kettle was charged with 70.1 grams of para phenyl phenol, 70.9 grams of $CH_2O$ (37.0% solution), 0.46 grams Aerosol OT (75.0% solution), 2.35 grams oxalic acid and 150 grams of xylene. The charge was heated for 13 minutes at which time refluxing began (83° C.). Refluxing was carried out for 45 minutes at which time 69.4 grams of p-sec-butyl phenol which had been dissolved in 150 grams of xylene was added to the kettle. Refluxing was carried out for an additional 15 minutes. $H_2O$ extraction was started and carried out until 55 mls. were extracted. The resin was then added to 7.5 pounds of the clay of Example 2 and process completed as in Example 12.

EXAMPLE 15

A one liter reaction kettle was charged with the chemicals listed below. The charge was heated for 20 minutes at which time refluxing began (82° C.). Refluxing was carried out for one hour at which time $H_2O$ extraction was started and carried out until 100 mls. of $H_2O$ were removed. (Temperature before extraction 91° C.—after extraction 110° C.). The resin was then cooked for 2 hours at 100° C. The resin was then added to 7.5 pounds of the clay of Example 6 which had been heated in a kneader by circulating steam. The resin modified clay was then dried and milled.

| Chemicals Used | Amount in Grams |
|---|---|
| Para Phenyl Phenl | 238.0 |
| 37.0% $CH_2O$ | 122.0 |
| Xylene | 112.0 |
| Aerosol OT (75% solution) | 0.53 |
| Oxalic Acid | 2.6 |

EXAMPLE 16

A one liter reaction kettle was charged with the chemicals listed below. The charge was heated for 15 minutes at which time refluxing began (84° C.). Refluxing was carried out for one hour at which time $H_2O$ extraction was started. $H_2O$ extraction was carried out until 55.0 mls. of $H_2O$ were extracted (temperature before extraction 90° C.—after extraction 120° C.). The resin was then added to 7.5 pounds of the clay of Example 6 which had been heated in a kneader by circulating steam. The resin modified clay was kneaded 10 minutes, dried and then milled.

| Chemicals Used | Amount in Grams |
|---|---|
| Para Phenyl Phenol | 70.1 |
| p-sec-Butyl Phenol | 69.4 |
| 37.0% $CH_2O$ | 70.9 |
| Xylene | 300 |
| Aerosol OT (75% solution) | 0.46 |
| Oxalic Acid | 2.4 |

EXAMPLE 17

A one liter reaction kettle was charged with the chemicals listed below. The charge was heated for 20 minutes at which time refluxing began (83° C.). Refluxing was carried out for one hour at which time $H_2O$ extraction was started and carried out until 100 mls. of $H_2O$ were extracted. The resin was then allowed to "cool" for 48 hours. The resin was reheated for 30 minutes and then added to 7.5 pounds of the clay of Example 6 which had been heated in a kneader by circulating steam. The resin modified clay was kneaded for 7 minutes, dried and milled.

| Chemicals Used | Amount in Grams |
|---|---|
| Para Phenyl Phenol | 238 |
| 37.0% $CH_2O$ | 122 |
| Xylene | 112 |
| Aerosol OT (75% solution) | 0.53 |
| Oxalic Acid | 2.6 |

EXAMPLE 18

A three liter flask was charged with the chemicals listed below. The charge was heated for 18 minutes at which time refluxing began (97° C.). Refluxing was carried out for one hour at which time $H_2O$ extraction was started (91° C.). $H_2O$ extraction was carried out until 415.0 mls. of $H_2O$ were extracted (109° C.). The resin was then added to 30.0 pounds of the clay of Example 6. The resin modified clay was mixed in a pin mixer for 10 minutes, dried and milled.

| Chemicals Used | Amount in Grams |
|---|---|
| Para Phenyl Phenol | 954.0 |
| 37.0% $CH_2O$ | 486.0 |
| Xylene | 450.0 |
| Aerosol OT (75% solution) | 2.1 |
| Oxalic Acid | 10.5 |

EXAMPLE 19

A one liter reaction kettle was charged with 140.1 grams of para phenyl phenol, 141.8 grams $CH_2O$ (37.0% solution), 0.93 grams Aerosol OT (75.0% solution), 4.7 grams oxalic acid and 200.0 grams of xylene. The charge was heated for 15 minutes at which time refluxing began (83° C.). Refluxing was carried out for 45 minutes at which time 138.8 grams of p-sec-butyl phenol which had been dissolved in 200 grams xylene was added to the kettle (74° C.). Refluxing was carried out for an additional 15 minutes. $H_2O$ extraction was then started (90° C.) and carried out until 115.0 mls. $H_2O$ were extracted. The resin was added to 7.5 pounds of pulverized clay of Example 6 which had been heated in a kneader by circulating steam. The resin modified clay was kneaded for 7 minutes, dried and milled.

EXAMPLE 20

A 500 ml. reaction kettle was charged with 70.1 grams of para phenyl phenol, 70.9 grams of $CH_2O$ (37.0% solution), 0.46 grams Aerosol OT (75.0% solution), 2.35 grams oxalic acid and 150.0 grams xylene. The charge was heated for 10 minutes at which time refluxing began. Refluxing was carried out for 45 minutes at which time 69.4 grams of p-sec-butyl phenol which had been dissolved in 150 grams xylene was added to the kettle (74° C.). Refluxing was carried out for an additional 15 minutes. $H_2O$ extraction was then started (90° C.) and 55.0 mls. of $H_2O$ (120° C.) extracted. The resin was then added to the clay and processed as in Example 19.

EXAMPLE 21

A 500 ml. reaction kettle was charged with the chemicals listed below. The charge was heated for 19 minutes at which time refluxing began (84° C.). Refluxing was carried out for one hour at which time $H_2O$ extraction was started (91° C.). $H_2O$ extraction was carried out until 60 mls. of $H_2O$ were extracted. The resin was added to 5.0 pounds of a water fractionated Georgia kaolin having a TAPPI brightness of 85.5% reflectance, 80% of its particles less than 2 microns, a Brookfield viscosity (70% slip, 20 r.p.m., #1 spindle, 25° C.) of 100–200 cps, a specific gravity (25° C.) of 2.6, a refractive index of 1.5 and a BET surface area of 10–11 $m^2/g$, which had been heated in a kneader by circulating steam. The resin modified clay was than kneaded for 10 minutes, dried and milled.

| Chemicals Used | Amount in Grams |
|---|---|
| Para Phenyl Phenol | 158.8 |
| 37.0% $CH_2O$ | 75.7 |
| Xylene | 75.0 |
| Aerosol OT (75.0% solution) | 0.45 |
| Oxalic Acid | 1.75 |

EXAMPLE 22

A one liter reaction kettle was charged with the chemicals listed below. The charge was heated for 30 minutes at which time refluxing began (84° C.). Refluxing was carried out for one hour at which time $H_2O$ extraction was started (92° C.). Extraction was carried out until 83.0 mls. of $H_2O$ were extracted. The resin was then added to 3180 grams of a pulverized water fractionated Georgia kaolin having a TAPPI brightness of 84.5% reflectance, 71% of its particles finer than 2 microns, a Brookfield viscosity (70% slip, 20 r.p.m.) #1 spindle, 25° C.) of 100–200 cps, a specific gravity (25° C.) of 2.6, a refractive index of 1.5–1.6 and a BET surface area of 9–10 $m^2/g$, which had been heated in a kneader by circulating steam. The resin modified clay was then kneaded for 10 minutes, dried and milled.

| Chemicals Used | Amount in Grams |
|---|---|
| Para Phenyl Phenol | 222.7 |
| 37.0% $CH_2O$ | 106.2 |
| Xylene | 105.0 |
| Aerosol OT (75.0% solution) | 0.64 |
| Oxalic Acid | 2.45 |

EXAMPLE 23

A Bakelite resin (phenolic brand CKM-5254 as described above—255,3 g) was dissolved by heating. The dissolved resin was added to 7.5 pounds of pulverized clay of the type of Example 6 which had been heated by circulating steam. The resin modified clay was mixed for 10 minutes and then milled.

EXAMPLE 24

A Bakelite resin (phenolic brand—255.3 g) was placed in a 500.0 ml. reaction kettle with 128 grams of xylene and dissolved by heating the charged batch to 120° C. The resin was then added to 7.5 pounds of a pulverized clay of Example 6 which had been heated by circulating steam. The resin modified clay was mixed for 10 minutes, dried and milled.

EXAMPLE 25

A one liter reaction kettle was charged with the chemicals listed below. The charge was heated for 19 minutes at which time refluxing began (81° C.). Refluxing was carried out for one hour at which time $H_2O$ extraction was started (86° C.). $H_2O$ extraction was carried out until 100.0 mls. of $H_2O$ was extracted. The resin was added to 7.5 pounds of pulverized clay of Example 6 which had been heated by circulating steam. The resin modified clay was then mixed for 7 minutes, dried and milled.

| Chemicals Used | Amount in Grams |
|---|---|
| Para Phenyl Phenol | 238.0 |
| 37.0% $CH_2O$ | 122.0 |
| Toluene | 112.0 |
| 75.0% Aerosol OT | 0.7 |
| Oxalic Acid | 2.6 |

EXAMPLE 26

A one liter reaction kettle was charged with the chemicals listed below. The charge was heated for 14 minutes at which time refluxing began (67.3° C.). Refluxing was carried out for one hour at which time $H_2O$ extraction was started (77° C.). $H_2O$ extraction was carried out until 100.0 mls. of $H_2O$ were extracted. The resin was then added to 7.5 pounds of the clay of Example 6 which had been heated in a kneader by circulating steam. The resin modified clay was then mixed for 7 minutes, dried, and milled.

| Chemicals Used | Amount in Grams |
|---|---|
| Para Phenyl Phenol | 238.0 |
| 37.0% $CH_2O$ | 122.0 |
| Benzene | 112.0 |
| 75.0% Aerosol OT | 0.7 |
| Oxalic Acid | 2.6 |

EXAMPLE 27

A one liter reaction kettle was charged with the chemicals listed below. The charge was heated for 16 minutes at which time refluxing began (68° C.). Refluxing was carried out for two hours at which time $H_2O$ extraction was started. Extraction was carried out until 100.0 mls. of $H_2O$ was extracted. The resin was then added to 7.5 pounds of the clay of Example 6 which had been heated in a kneader by circulating steam. The resin modified clay was mixed for 7 minutes, dried and then milled.

| Chemicals Used | Amount in Grams |
|---|---|
| Para Phenyl Phenol | 238.0 |
| 37.0% $CH_2O$ | 122.0 |
| Benzene | 112.0 |
| 75.0% Aerosol OT | 0.7 |
| Oxalic Acid | 2.6 |

EXAMPLE 28

A one liter reaction kettle was charged with the chemicals listed below. The charge was heated for 26 minutes at which time refluxing began (98° C.). Refluxing was carried out for one hour (98° C.). The resin was added to 7.5 pounds of the clay of Example 6 which had been heated in a kneader by circulating steam. The resin modified clay was then mixed 7 minutes, dried and milled.

| Chemicals Used | Amount in Grams |
|---|---|
| Para Phenyl Phenol | 238.0 |
| 37.0% $CH_2O$ | 122.0 |
| N, N-Dimethyl Formamide | 112.0 |
| 75.0% Aerosol OT | 0.7 |
| Oxalic Acid | 2.6 |

EXAMPLE 29

A one liter reaction kettle was charged with the chemicals listed below. The charge was heated for 22 minutes at which time refluxing began (77° C.). Refluxing was carried out for one hour at which time $H_2O$ extraction was started (98.5° C.). $H_2O$ extraction was carried out until 100.0 mls. of $H_2O$ was extracted. The resin was then added to 7.5 pounds of clay which had been heated by circulating steam. The resin modified clay was mixed for 7 minutes, dried and milled.

| Chemicals Used | Amount in Grams |
|---|---|
| Para Phenyl Phenol | 238.0 |
| 2,4-pentanedione ($CH_3COCH_2COCH_3$) | 112.0 |
| 37.0% $CH_2O$ | 122.0 |
| 75.0% Aerosol OT | 0.7 |
| Oxalic Acid | 2.6 |

EXAMPLE 30

A one liter reaction kettle was charged with the chemicals listed below. The charge was heated for 20 minutes at which time refluxing began (85° C.). Refluxing was carried out for 1 hour at which time $H_2O$ extraction was started (93° C.). $H_2O$ extraction was carried out until 80.0 mls. of $H_2O$ were extracted. The resin was added to 5.0 pounds of the clay of Example 22 which had been heated in a kneader by circulating steam. The resin modified clay was mixed 7 minutes, milled, dried, and milled again.

| Chemicals Used | Amount in Grams | |
|---|---|---|
| Para Phenyl Phenol | 212.5 | (1.25 moles) |
| 37.0% $CH_2O$ | 101.3 | (1.25 moles) |
| Xylene | 75.0 | |
| 75.0% Aerosol OT | 0.4 | |
| Oxalic Acid | 1.75 | |

EXAMPLE 31

A one liter reaction kettle was charged with the chemicals listed below. The charge was heated for 20 minutes at which time refluxing began (86° C.). Refluxing was carried out for one hour at which time $H_2O$ extraction was started (93° C.). $H_2O$ extraction was carried out until 80.0 mls. of $H_2O$ were extracted (107° C.). The resin was added to 5.0 pounds of clay heated in a kneader by circulating steam. The resin modified clay was mixed for 7 minutes, milled, dried and milled again.

| Chemicals Used | Amount in Grams | |
|---|---|---|
| Para Phenyl Phenol | 212.5 | (1.25 moles) |
| 37.0% $CH_2O$ | 101.3 | (1.25 moles) |
| Xylene | 100.0 | |
| 75.0% Aerosol OT | 0.4 | |
| Oxalic Acid | 1.75 | |

EXAMPLE 32

A one liter reaction kettle was charged with the chemicals listed below. The charge was heated for 20 minutes at which time refluxing began (85° C.). Refluxing was carried out for one hour at which time $H_2O$ extraction was started (91° C.). 80.0 mls. of $H_2O$ were extracted (107° C.). The resin was then added to 5.0 pounds of pulverized clay which had been heated in a kneader by circulating steam. The modified clay was mixed for 7 minutes, milled, dried and milled again.

| Chemicals Used | Amount in Grams |
|---|---|
| Para Phenyl Phenol | 265.6 |
| 37.0% $CH_2O$ | 101.3 |
| Xylene | 125.1 |
| 75.0% Aerosol OT | 0.4 |

-continued

| Chemicals Used | Amount in Grams |
|---|---|
| Oxalic Acid | 1.75 |

EXAMPLE 33

A one liter reaction kettle was charged with the chemicals listed below. The charge was heated for 21 minutes at which time refluxing began (85° C.). Refluxing was carried out for one hour at which time $H_2O$ extraction was started (92° C.). $H_2O$ extraction was carried out until 80.0 mls. of $H_2O$ were extracted (108° C.). The resin was added to 5.0 pounds of pulverized clay which had been heated in a kneader by circulating steam. The resin modified clay was then mixed for 7 minutes, milled, dried and milled again.

| Chemicals Used | Amount in Grams |
|---|---|
| Para Phenyl Phenol | 235.9 |
| 37.0% $CH_2O$ | 101.3 |
| Xylene | 111.1 |
| 75.0% Aerosol OT | 0.4 |
| Oxalic Acid | 1.75 |

EXAMPLE 34

A one liter reaction kettle was charged with the chemicals listed below. The charge was heated for 21 minutes at which time refluxing began (85° C.). Refluxing was carried out for one hour at which time $H_2O$ extraction was started. $H_2O$ extraction was carried out until 89.0 mls. of $H_2O$ were extracted (107° C.). The resin was added to 5.0 pounds of pulverized clay which had been heated in a kneader by circulating steam. The modified clay was mixed for 7 minutes, milled, dried and milled again.

| Chemicals Used | Amount in Grams |
|---|---|
| Para Phenyl Phenol | 212.5 |
| 37.0% $CH_2O$ | 111.5 |
| Xylene | 100.0 |
| 75.0% Aerosol OT | 0.4 |
| Oxalic Acid | 1.75 |

EXAMPLE 35

A one liter reaction kettle was charged with the chemicals listed below. The charge was heated for 23 minutes at which time refluxing began (85° C.). Refluxing was carried out for one hour at which time $H_2O$ extraction was started (91° C.). $H_2O$ extraction was carried out until 505.0 mls. $H_2O$ were extracted (107° C.). The resin was added to 30.0 pounds of pulverized clay which had been heated in a pin mixer. The modified clay was mixed 10 minutes, milled, dried and milled again.

| Chemicals Used | Amount in Grams |
|---|---|
| Para Phenyl Phenol | 1275.0 |
| 37.0% $CH_2O$ | 607.8 |
| Xylene | 600.0 |
| 75.0% Aerosol OT | 2.4 |
| Oxalic Acid | 10.5 |

This modified clay showed the following properties:

| Test | |
|---|---|
| Reproducing effect | Fair |
| G. E. Brightness | 78.0 |
| 68.0% Viscosity | Brookfield = 640 cps, Herc. = 7.0 dynes |
| Particle Size | $+10\ \mu = 25.4$, $+5\ \mu = 28.6$, $-2\ \mu = 54.9$ |
| Valley Abrasion | 5.8 mg. |
| 28% pH | 4.55 |
| % Moisture | 0.5 |
| 325 Mesh Residue | 11.0245% |
| 200 Mesh Residue | 4.6017% |

EXAMPLE 36

A three liter flask was charged with the chemicals listed below. The charge was heated for 20 minutes at which time refluxing began (85° C.). Refluxing was carried out for one hour at which time $H_2O$ extraction was started (92° C.). $H_2O$ extraction was carried out until 340.0 mls. of $H_2O$ were extracted (109° C.). The resin was added to 20.0 pounds of pulverized clay of Example 21 which had been heated in a pin mixer. The modified clay was mixed 10 minutes, milled, dried, and milled again.

| Chemicals Used | Amount in Grams |
|---|---|
| Para Phenyl Phenol | 849.2 |
| 37.0% $CH_2O$ | 405.0 |
| Xylene | 400.0 |
| 75.0% Aerosol OT | 1.6 |
| Oxalic Acid | 7.0 |

EXAMPLE 37

A three liter flask was charged with the chemicals listed below. The charge was heated for 22 minutes at which time refluxing began (84° C.). Refluxing was carried out for one hour at which time $H_2O$ extraction was started (92° C.). $H_2O$ extraction was carried out until 505.0 mls. $H_2O$ were extracted (108° C.). The resin was added to 30.0 pounds of pulverized clay which had been heated in a pin mixer. The modified clay was mixed 10 minutes, milled, dried, and milled again.

| Chemicals Used | Amount in Grams |
|---|---|
| Para Phenyl Phenol | 1275.0 |
| 37.0% $CH_2O$ | 607.8 |
| Xylene | 600.0 |
| 75.0% Aerosol OT | 2.4 |
| Oxalic Acid | 10.5 |

This modified clay showed the following properties:

| Test | |
|---|---|
| Reproducing Effect | Fair |
| G. E. Brightness | 79.1 |
| 68.0% Viscosity | Brookfield = 1360 cps, Herc. = 15 |
| Particle Size | $+10\ \mu = 34.1$, $+5\ \mu = 137.8$, $-2\ \mu = 28.1$ |
| Valley Abrasion | 4.5 mg |
| 28% pH | 6.4 |
| % Moisture | 0.5 |
| 325 Mesh Residue | 16.1648% |
| 200 Mesh Residue | 4.5934% |

EXAMPLE 38

A two liter flask was charged with the chemicals listed below. The charge was heated for 20 minutes at which time refluxing began (81° C.). Refluxing was carried out for one hour at which time $H_2O$ extraction was started (93° C.). $H_2O$ extraction was carried out until 192.0 mls. of $H_2O$ were extracted (110° C.). The resin was added to 25.0 pounds of a pulverized and leached clay of Example 22 which had been heated in a pin mixer. The modified clay was then milled, dried, and milled again.

| Chemicals Used | Amount in Grams |
|---|---|
| Para Phenyl Phenol | 530.4 |
| 37.0% $CH_2O$ | 252.6 |
| Xylene | 250.0 |
| 75.0% Aerosol OT | 1.0 |
| Oxalic Acid | 4.4 |

EXAMPLE 39

A three liter flask was charged with the chemicals listed below. The charged chemicals were heated for 23 minutes at which time refluxing began (80° C.). Refluxing was carried out for one hour at which time $H_2O$ extraction was started (92° C.). $H_2O$ extraction was carried out until 314 mls. of $H_2O$ were extracted (110° C.). The resin was added to 25.0 pounds of a leached pulverized clay of the type of Example 22 which had been heated in a pin mixer. The modified clay was milled, dried and milled again.

| Chemicals Used | Amount in Grams |
|---|---|
| Para Phenyl Phenol | 795.6 |
| 37.0% $CH_2O$ | 379.4 |
| Xylene | 375.0 |
| 75.0% Aerosol OT | 1.5 |
| Oxalic Acid | 6.6 |

EXAMPLE 40

A three liter flask was charged with the chemicals listed below. The charge was heated for 32 minutes at which time refluxing began (80° C.). Refluxing was carried out for one hour at which time $H_2O$ extraction was started (92° C.). $H_2O$ extraction was carried out until 400 mls. of $H_2O$ were extracted (110° C.). The resin was added to 25.0 pounds of leached pulverized clay of Example 22 which had been heated in a pin mixer. The modified clay was milled, dried, and milled again.

| Chemicals Used | Amount in Grams |
|---|---|
| Para Phenyl Phenol | 1060.8 |
| 37.0% $CH_2O$ | 505.9 |
| Xylene | 500.0 |
| 75.0% Aerosol OT | 2.0 |
| Oxalic Acid | 8.75 |

A summary of several of the typical polymerization formulations disclosed in the above examples is given below in Table II.

TABLE II

POLYMERIZATIN FORMULATION VARIATIONS

| MATERIAL | WEIGHT IN GRAMS EXAMPLE NO. 3 | EXAMPLE NO. 11 | EXAMPLE NO. 13 | EXAMPLE NO. 25 | EXAMPLE No. 26 |
|---|---|---|---|---|---|
| Para Phenyl Phenol | 238.0 | 223.0 | 140.1 | 238.0 | 238.0 |
| Para Sec Butyl Phenol | | 94.5 | 138.8 | | |
| 37% Formaldehyde Solution | 122.0 | 170.0 | 141.8 | 122.0 | 122.0 |
| Xylene | 112.0 | 400.0 | 400.0 | | |
| Toluene | | | | 112.0 | |
| Benzene | | | | | 112.0 |
| Aerosol OT | 0.53 | 0.93 | 0.93 | 0.7 | 0.7 |
| Oxalic Acid | 2.6 | 4.7 | 4.7 | 2.6 | 2.6 |

| MATERIAL | WEIGHT IN GRAMS EXAMPLE NO. 31 | EXAMPLE NO. 32 | EXAMPLE NO. 33 | EXAMPLE NO. 34 |
|---|---|---|---|---|
| Para Phenyl Phenol | 212.5 | 265.6 | 235.9 | 212.5 |
| 37% Formaldehyde Solution | 101.5 | 101.3 | 101.3 | 111.5 |
| Xylene | 100.0 | 125.1 | 111.1 | 100.0 |
| Aerosol OT | 0.4 | 0.4 | 0.4 | 0.4 |
| Oxalic Acid | 1.75 | 1.75 | 1.75 | 1.75 |

EXAMPLE 41

Cold clay of Example 22 (25.0#) was treated with 7.5% commercial grade Bakelite resin CKM-5254 as described above (851.3 grams) which had been dissolved in 3.75% (425.6 grams) of heated xylene. After modifying, the clay was milled, desolventized, remilled, slurried to 30.0% solids using 6#/ton TSPP (34.1 grams) and bead ground using 36.6% beads and 63.4% slurry by volume with impeller speed of 1250 r.p.m. (1960 ft./min. peripheral speed) and a retention time of one hour. After grinding the slurry was screened through a 100 mesh screen, flocculated to a pH=4.65 with alum, filtered using a rotary filter, redispersed and spray dried.

EXAMPLE 42

Cold clay of Example 22 (25.0#) was treated with 7.5% commercial grade Bakelite resin as described above (851.3 grams) which had been dissolved in 7.5% (851.3 grams) xylene. The resin was dissolved in the xylene by heating the mixture. After modifying, the clay was milled, desolventized, remilled, slurried to 30.0% solids using 6#/ton TSPP (34.1 grams) and ground using 36.6% glass beads and 63.4% slurry by volume with impeller speed of 1250 r.p.m. (1960 ft./min. peripheral speed) and a retention time of one hour. After grinding the slurry was screened through a 100 mesh screen, flocculated to a pH=4.65 with alum, filtered using a rotary filter, redispersed and then spray dried.

EXAMPLE 43

Cold clay of the type of Example 22 (25.0#) was treated with 7.5% commercial Bakelite resin as described above (851.3 grams) which had been dissolved in 3.75% (425.6 grams) of xylene. After modifying, the clay was desolventized, slurried to 30.0% solids using 6#/ton TSPP and then ground using 36.6% beads and 63.4% slurry by volume with an impeller speed of 1250 r.p.m. (1960 ft./min. peripheral speed) and a retention time of one hour. After grinding, the slurry was screened through a 100 mesh screen and spray dried.

EXAMPLE 44

An unheated clay of Example 22 (25.0#) was treated with 7.5% commercial grade Bakelite resin as described above (851.3 grams) which had been dissolved in 7.5% (851.3 grams) of xylene. After modifying, the clay was desolventized, slurried to 30.0% solids using 6#/ton TSPP and then ground using 36.6% beads and 63.4% slurry by volume with an impeller speed of 1250 r.p.m. (1960 ft./min. peripheral speed) and a retention time of one hour. After grinding, the slurry was screened through a 100 mesh screen and spray dried. The spray dried clay was reslurried (maximum solids=30.0%) and coated as described below.

EXAMPLE 45

15.0 pounds of the clay of Example 22 was slurried to 30.0% solids using 6#/ton TSPP (20.4 grams), then treated with 7.5% commercial grade Bakelite resin as described above (510.8 grams) which had been milled. The slurry/resin was mixed 5 minutes and then ground using 36.6% beads and 63.4% slurry by volume with an impeller speed of 1250 r.p.m. (1960 ft./min. peripheral speed) and a retention time of one hour. After grinding, the slurry was screened through a 100 mesh screen and spray dried.

EXAMPLE 46

Twenty-five pounds of cold clay was treated with 5.0% (567.5 grams) of commercial grade Bakelite resin as described above which had been dissolved in 10.0% xylene (1135.0 grams). After modifying the clay in a pin mixer, the clay was desolventized. After desolventizing the clay, it was slurried to 30.0% solids using 6#/ton TSPP (33.8 grams) and ground using 36.6% beads and 63.4% slurry by volume with impeller speed of 1250 r.p.m. (1960 ft./min. peripheral speed) and a retention time of one hour. After bead grinding, the slurry was screened through a 100 mesh screen and spray dried.

EXAMPLE 47

Twenty-five pounds of cold clay was treated with 1.0% (113.5 grams) of commercial grade Bakelite resin as described above which had been dissolved in 10.0% xylene (1135.0 grams). After modifying the clay in a pin mixer, the clay was desolventized. After desolventizing, the clay was milled.

EXAMPLE 48

Twenty-five pounds of cold clay was treated with 15.0% (1702.5 grams) of commercial grade Bakelite as described above which had been dissolved in 15.0% xylene (1702.5 grams). After modifying the clay in a pin mixer, the clay was desolventized. After desolventizing, the clay was milled. Coating colors of this modified clay were made up as follows:

100 parts modified clay (40.0% solids)
8 parts Penford Gum #280 (30.0% solids)
6 parts Dow Latex #620 (50.0% solids)

The modified clay was slurried 10 minutes via a mixer, then latex and starch were added and the coating color mixed 5 minutes using a mixer with a 2" crebs impeller. The coating color was applied to Mead stock by the hand drawdown technique. Reproductiveness was excellent.

EXAMPLE 49

Coating colors made with the modified clays of the examples indicated were prepared by the following formula:

86 parts modified clay (50.0% solids)
8 parts Penford Gum #280 (30.0% solids)
6 parts Dow Latex #620 (50.0% solids)

The clay was slurried for 10 minutes via a mixer, then the latex and gum were added and the coating color mixed 5 minutes using a mixer with a 2" crebs impeller.

The coating colors were applied to 30–32# Bowater's paper stock by hand drawdown technique.

Half of the sheets were super calendered at 15 PLI for 12 nips.

| EXAMPLE NO. | REPRODUCING EFFECT |
|---|---|
| Example 2 | Good |
| Example 3 | Good |
| Example 4 | Fair to Good |
| Example 6 | Good |
| Example 7 | Good |

EXAMPLE 50

The coating colors were made up by the following formula:

100 parts modified clay (50.0% solids)
8 parts Penford Gum #280 (30.0% solids)
6 parts Dow Latex #620 (50.0% solids)

The clay was slurried for 10 minutes via a mixer, then the latex and starch were added and the coating color mixed 5 minutes using a mixer with a 2" crebs impeller.

The coating colors were applied to 30–32# Bowater's paper stock by hand drawdown technique.

| EXAMPLE NO. | REPRODUCING EFFECT |
|---|---|
| Example 10 | Good |
| Example 11 | Good |
| Example 12 | Poor |
| Example 13 | Poor |
| Example 14 | Good |
| Example 15 | Good |
| Example 16 | Poor |
| Example 17 | Fair |
| Example 18 | Fair |
| Example 19 | Fair |
| Example 20 | Fair |
| Example 21 | Fair |
| Example 22 | Good |
| Example 23 | Poor |
| Example 24 | Good |
| Example 25 | Good |
| Example 26 | Good |

-continued

| EXAMPLE NO. | REPRODUCING EFFECT |
|---|---|
| Example 27 | Fair |
| Example 30 | Good |
| Example 31 | Very Good |
| Example 32 | Excellent |
| Example 33 | Very Good |
| Example 34 | Very Good |
| Example 35 | Very Good |
| Example 36 | Fair |
| Example 41 | Excellent |
| Example 42 | Excellent |
| Example 43 | Excellent |

EXAMPLE 51

150 pounds of commercial grade Bakelite resin of the type described above was made down with 200 pounds of xylene. A preheated kaolin clay of the type of Example 21 was added at the rate of 3 tons per hour along with the resin solvent makedown at a regulated flow rate to a steam heated pin auger where the hot clay particles were coated with approximately 7.5% resin based on the clay.

The modified clay was then discharged from the auger and passed through a pin mixer. The modified clay was then passed through a jacketed, steam heated desolventizer by a double screw conveyor and cooled.

Following cooling, the modified clay was subjected to impact milling and made down to a 30% solids aqueous slurry. This slurry was bead ground for 15 minutes with a 45:55 grinding media to slurry ratio and a peripheral impeller speed of 1960 feet per minute.

After bead grinding, the modified clay was flocculated with aluminum sulfate to a pH of 4.5 and filtered. The filtered slurry cake was redispersed and prepared for coating.

The above procedure was repeated with addition rates appropriate to produce a 16.2% resin modified clay.

Three samples of clay with the 16.2% resin level of modification were produced and subjected respectively to 15, 7.5 and 5 minute retention times in the bead grinding step of the above described process.

For control purposes, physical mixtures of resin and clay were produced corresponding respectively to treatment levels of 16.2% and 7.5% resin modifications, and these samples are designated "blends" in Table III below.

The modified clays and resin-clay blends described above were made up in a coating color using an 816 Penford 280 gum/Dow 620 latex blend as the binder system. Hand drawdowns of the coating color were made on a 30# paper stock with a coat weight of approximately 4.5 pounds/ream. The comparison was made by determining the intensity of color development on the coated sheets by placing a commercial dye encapsulation sheet over the test record member and passing the pair through a machine calender to break the encapsulations uniformly. Subsequently, the intensity of color development was measured at fixed time intervals on an opacimeter. The lower the opacimeter reading, the more intense the color and the more acceptable the record member. For comparison, commercially obtained sheets having a 16.2% resin blend formulation were evaluated in a like manner. Table III summarizes these results.

TABLE III

COMPARISON OF CLAY/RESIN SYSTEMS ON COATED SHEETS

| Clay/Resin Composition | Coat Weight | Sheet % Calender Intensity* 15 Seconds | 2 Minutes | 24 Hour |
|---|---|---|---|---|
| 7 ½% Resin Modified Sample (Example 51) | 5.01 | 58 | 43 | 40 |
| 7 ½% Resin Modified Sample (Example 51) | 4.28 | 56 | 44 | 39 |
| 16.2% Resin Modified Sample - Bead Ground 15 minutes (Example 51) | 4.76#/ream | 58 | 48 | 41 |
| 16.2% Resin Modified Sample - Bead Ground 7.5 minutes (Example 51) | 4.00#/ream | 49 | 38 | 36 |
| 16.2% Resin Modified Sample - Bead Ground 5 minutes (Example 51) | 4.01#/ream | 48 | 39 | 35 |
| 16.2% Resin Blend | 4.47#/ream | 84 | 73 | 64 |
| 7.5% Resin Blend | 4.67#/ream | 81 | 76 | 74 |
| 16.2% Resin Blend Commercial Sheet | 8.50#/ream | 50 | 42 | 39 |
| 16.2% Resin Blend Commercial Sheet | 6.5#/ream | 60 | 48 | 43 |

$$*\% \text{ Calender Intensity} = \frac{\text{Average Reflectance of Printed Area} \times 100}{\text{Average Reflectance of Background}}$$

A low value indicates a high contrast ratio of printed to background and a sharp image.
A high calender intensity value represents a low contrast ratio and a poor image.

While the present invention has been particularly described in terms of specific embodiments thereof, it will be understood in view of the present disclosure, that numerous variations are now enabled to those skilled in the art, which variations in propriety, are yet within the true scope of the instant teaching. Accordingly the present invention should be broadly construed and limited only by the scope and spirit of the claim now appended hereto.

What is claimed is:

1. A method for producing a coating composition of kaolin clay particles encapsulated within an oil soluble organic polymeric material for use in preparing a sensitized surface for a record member, said method comprising the steps of:

(a) heating a body of kaolin clay to a temperature in the range of 80° to 120° C.;

(b) combining said heated clay with a mixture of said organic polymeric material and a solvent heated to a temperature in the range of 90° to 125° C.;

(c) subjecting the combined mixture of clay, polymer and solvent to high shear mixing and compaction by flowing said combined mixture through a high speed high intensity pin mixer having a pitch decreasing in the direction of flow, said pin mixer operating at rotational speeds on the order of 100 to 1000 rpm;

(d) desolventizing said combined mixture in the presence of shearing forces;

(e) cooling said desolventized mixture;

(f) milling the cooled mixture;

(g) making down the milled mixture in water to form a slurry; and (h) bead grinding said slurry.

2. A method in accordance to claim 1 wherein said slurry contains less than about 40% by weight of clay, and the bead grinding medium is selected from the group consisting of microspheroids of an aluminum magnesium alloy and micro-spheroids of glass having a specific gravity of about 2.45.

3. A method in accordance to claim 2 wherein said oil soluble organic polymeric material is selected from the group consisting of phenol-aldehyde and phenol-acetylene polymers, maleic acid-rosin resins, partially or wholly hydrolyzed styrene-maleic anhydride copolymers, ethylene-maleic anhydride copolymers, carboxy polymethylene and wholly or partly hydrolyzed vinyl methyl ether-maleic anhydride copolymers.

* * * * *

UNITED STATES PATENT AND TRADEMARK OFFICE
CERTIFICATE OF CORRECTION

PATENT NO. : 4,186,224
DATED : January 29, 1980
INVENTOR(S) : Thomas A. Grillo

It is certified that error appears in the above-identified patent and that said Letters Patent are hereby corrected as shown below:

In the Drawings:

Figure 1, "POLINERIZED" should be -- POLYMERIZED --.

Figure 1, "MINING" should be -- MIXING --.

Figure 2:
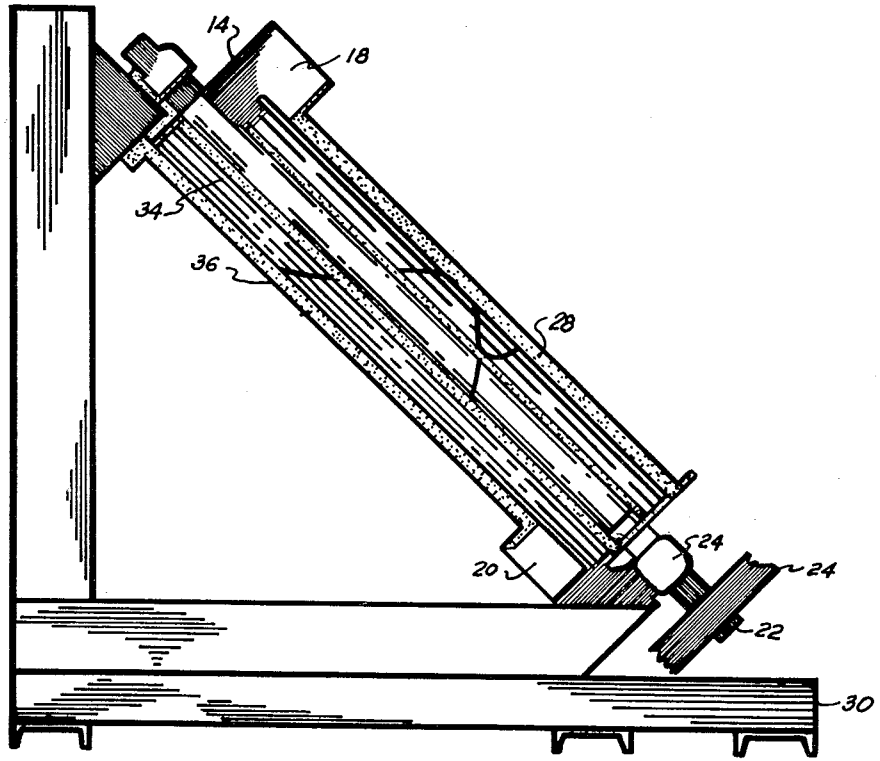
FIG. 2 is a partially sectional, partially broken away view of the pin mixer apparatus utilized in connection with the process set forth in FIG. 1.

Figure 2, Sheet 2 of 3, of the drawings should be deleted to insert the attached figure 2 therefor.

Figure 3, part 46, and in drawing on first page of patent, "pin miner" should be -- pin mixer --.

Figure 3, part 42, and in drawing on first page of patent, "maolin clay" should be -- kaolin clay --.

In the Specifications:

Column 2, line 25, "end" should be -- and --.

Column 2, line 51, "preceeding" should be -- preceding --.

Column 12, line 44, "than" should be -- then --.

Column 15, line 6, "Para Phenyl Phenl" should be -- Para Phenyl Phenol --.

Column 17, line 29, "255,3" should be -- 255.3 --.

UNITED STATES PATENT AND TRADEMARK OFFICE

CERTIFICATE OF CORRECTION

PATENT NO. : 4,186,224

DATED : January 29, 1980

INVENTOR(S) : Thomas A. Grillo

It is certified that error appears in the above-identified patent and that said Letters Patent are hereby corrected as shown below:

Column 27, in the second line below "TABLE III", the heading "Sheet" should be -- Sheet Sensitivity --.

Column 27, line 37, "claim" should be -- claims --.

Signed and Sealed this

*Twelfth* Day of *August 1980*

[SEAL]

*Attest:*

SIDNEY A. DIAMOND

*Attesting Officer*

*Commissioner of Patents and Trademarks*